US008583002B2

(12) United States Patent
Yagi et al.

(10) Patent No.: US 8,583,002 B2
(45) Date of Patent: Nov. 12, 2013

(54) POWDER CONTAINER, CLEANING DEVICE, AND IMAGE FORMING APPARATUS INCLUDING SEALING MEMBER

(75) Inventors: Hiroaki Yagi, Kanagawa (JP); Hirofumi Goto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 217 days.

(21) Appl. No.: 13/156,090

(22) Filed: Jun. 8, 2011

(65) Prior Publication Data

US 2012/0121288 A1 May 17, 2012

(30) Foreign Application Priority Data

Nov. 15, 2010 (JP) ..... 2010-255035

(51) Int. Cl.
*G03G 15/08* (2006.01)
*G03G 15/16* (2006.01)

(52) U.S. Cl.
USPC ..... 399/105; 399/101

(58) Field of Classification Search
USPC ..... 399/101; 277/311
See application file for complete search history.

(56) References Cited

U.S. PATENT DOCUMENTS

| | | | | |
|---|---|---|---|---|
| 3,576,326 | A * | 4/1971 | Hafner et al. | 277/500 |
| 5,521,680 | A * | 5/1996 | Young | 399/311 |
| 6,047,153 | A | 4/2000 | Kawaguchi | |
| 2008/0031666 | A1 * | 2/2008 | Tawada | 399/360 |
| 2008/0211195 | A1 * | 9/2008 | Miyamoto et al. | 277/608 |
| 2008/0219698 | A1 * | 9/2008 | Shimizu et al. | 399/116 |
| 2008/0219699 | A1 * | 9/2008 | Kimura et al. | 399/120 |
| 2010/0128328 | A1 | 5/2010 | Hozono | |

FOREIGN PATENT DOCUMENTS

JP 2009-085999 A 4/2009

* cited by examiner

*Primary Examiner* — David Gray
*Assistant Examiner* — Tyler Hardman
(74) *Attorney, Agent, or Firm* — Sughrue Mion, PLLC

(57) ABSTRACT

A powder container includes a housing including a container chamber, a rotation member extending in an axial direction, and a sealing member. The housing includes a first wall portion having a first hole into which an end portion of the rotation member is inserted. The rotation member includes a second wall facing a part of the first wall portion around the first hole with a distance therebetween. The sealing member has a second hole through which the rotation member extends, is interposed between the part of the first wall portion around the first hole and the second wall portion, and includes a foam member that is contractible and a pair of sheet members respectively contacting the part of the first wall portion around the first hole and the second wall portion and having a friction coefficient lower than the foam member.

6 Claims, 9 Drawing Sheets

POWDER CONTAINER, CLEANING DEVICE, AND IMAGE FORMING APPARATUS INCLUDING SEALING MEMBER

CROSS-REFERENCE TO RELATED APPLICATIONS

This application is based on and claims priority under 35 USC 119 from Japanese Patent Application No. 2010-255035 filed Nov. 15, 2010.

BACKGROUND (i) Technical Field

The present invention relates to a powder container, a cleaning device, and an image forming apparatus.

(ii) Related Art

There are image forming apparatuses that form a toner image, transfer the toner image to a medium such as a sheet, and fix the toner image. Such image forming apparatuses include a cleaning device that cleans an image carrier by removing residual substances such as toner, which remain on the image carrier after the image has been transferred, from the image carrier. It is necessary that the cleaning device have a structure for preventing residual substances that have been once recovered from leaking from the cleaning device.

SUMMARY

According to an aspect of the invention, a powder container includes a housing including a container chamber for containing powder; a rotation member disposed in the housing, the rotation member extending in an axial direction in which a rotation axis extends and rotating around the rotation axis; and a sealing member, wherein the housing includes a first wall portion having a first hole extending through the housing, an end portion of the rotation member in the axial direction being inserted into the first hole, the first wall portion defining an end of the container chamber in the axial direction, wherein the rotation member includes a second wall portion extending along a plane that intersects the rotation axis in the container chamber in a state in which the end portion of the rotation member is inserted into the first hole, the second wall portion facing a part of the first wall portion around the first hole with a distance therebetween, and wherein the sealing member has a second hole through which the rotation member extends, the sealing member is interposed between the part of the first wall portion around the first hole and the second wall portion, and the sealing member includes a foam member and a pair of sheet members sandwiching the foam member therebetween, the foam member being contractible due to pressure, the pair of sheet members respectively contacting the part of the first wall portion around the first hole and the second wall portion, the pair of sheet members having a friction coefficient lower than a friction coefficient of the foam member, the pair of sheet members not being bonded to the part of the first wall portion around the first hole and the second wall portion.

BRIEF DESCRIPTION OF THE DRAWINGS

An exemplary embodiment of the present invention will be described in detail based on the following figures, wherein.

DETAILED DESCRIPTION

Hereinafter, an exemplary embodiment of the present invention will be described.

Figure 1:
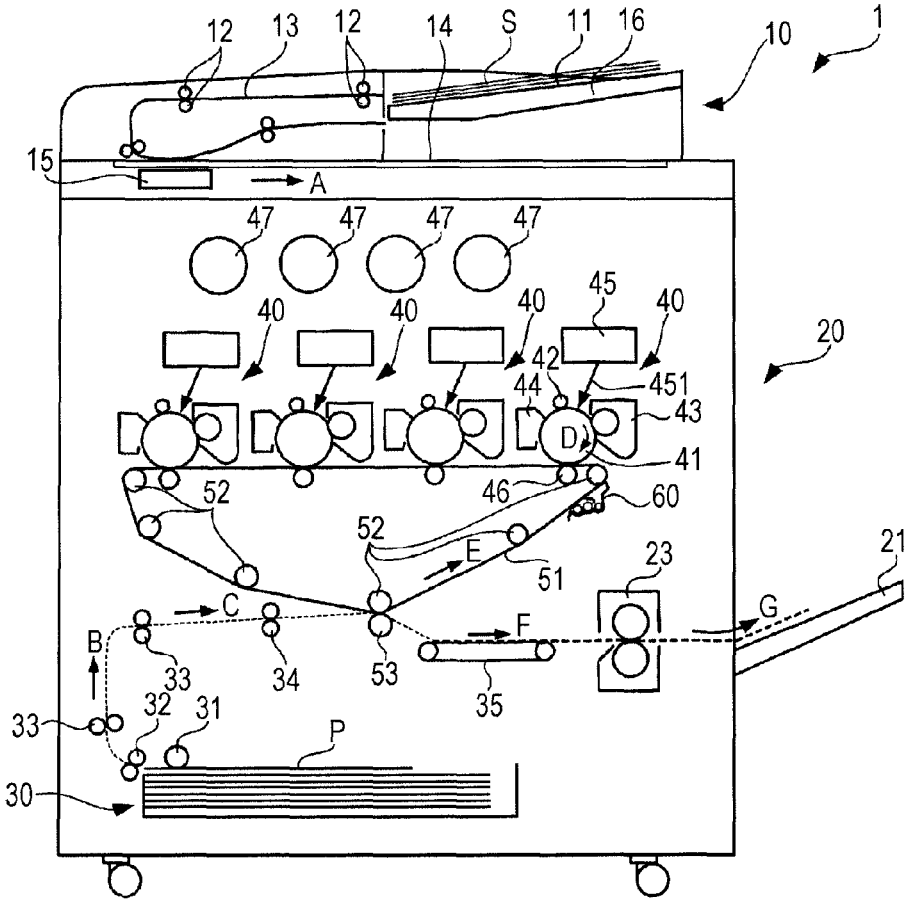
FIG. 1 is a schematic view of an image forming apparatus according to an exemplary embodiment of the present invention.

FIG. 1 is a schematic view of an image forming apparatus 1 according to the exemplary embodiment of the present invention. The image forming apparatus 1 includes a cleaner 60, which is an example of a cleaning device.

The image forming apparatus 1 includes an image reading section 10 and an image forming unit 20.

The image reading section 10 includes a document feeding tray 11 on which documents S are stacked. The documents S stacked on the document feeding tray 11 are fed one by one by a transport roller 12 along a transport path 13. A document reading optical system 15 disposed under a document reading table 14, which is made of a transparent glass, reads characters and images on the transported document S, and the document S is output to a document output tray 16.

The image reading section 10 includes a hinge that extends in a horizontal direction in a back part thereof. The document feeding tray 11 and the document output tray 16 are liftable around the hinge. The document reading table 14 is disposed below the document feeding tray 11 and the document output tray 16 when these trays are lifted. In addition to reading documents stacked on the document feeding tray 11, the image reading section 10 is capable of reading a document placed on the document reading table 14. In this case, the document reading optical system 15 moves in the direction of arrow A and reads characters and images on the document placed on the document reading table 14.

The document reading optical system 15 generates an image signal, and the image signal is input to the image forming unit 20. The image forming unit 20 forms an image on the basis of the input image signal as follows.

A sheet container 30 is disposed below the image forming unit 20, an the sheet container 30 contains a stack of sheets P. The sheets P are fed from the sheet container 30 by a pick-up roller 31, separated into individual sheets by separation rollers 32, and one of the separated sheets P is transported by transport rollers 33 in the direction of arrows B and C. Then, standby rollers 34 adjust the transport timing, and the sheet P is further transported. Transportation of the sheet P after passing the standby rollers 34 will be described below.

The image forming unit 20 includes four image forming engines 40. The image forming engines 40 respectively form toner images by using yellow (Y), magenta (M), cyan (C), and black (K) toners.

Because the four image forming engines 40 have the same structure, one of the image forming engines 40 at the right-most position in FIG. 1 will be described here.

Each of the image forming engines 40 includes a photoconductor 41 that rotates in the direction of arrow D. A charger 42, a developing unit 43, and a cleaner 44 are disposed around the photoconductor 41. An exposure unit 45 is disposed above the photoconductor 41. A transfer member 46 is disposed so as to face the photoconductor 41 with an intermediate transfer belt 51, which will be described below, therebetween.

The photoconductor 41, which has a cylindrical shape, is charged and then discharged by being exposed to light, whereby an electrostatic latent image is formed on the surface of the photoconductor 41.

The charger 42 charges the surface of the photoconductor 41 to a certain potential.

An image signal is input to the exposure unit 45, and the exposure unit 45 emits a light beam 451 that is modulated in accordance with the input image signal. The exposure unit 45 forms an electrostatic latent image on the surface of the photoconductor 41 by repeatedly scanning a part of the surface of the photoconductor 41, which rotates in the direction of arrow D, that has been charged by the charger 42 in a direction parallel to the rotation axis of the photoconductor 41 (a direction perpendicular to the paper surface of FIG. 1) with the light beam 451.

The developing unit 43 forms a toner image on the surface of the photoconductor 41 by developing the electrostatic latent image, which has been formed on the surface of the photoconductor 41 by being scanned with the light beam 451.

The toner image, which has been developed on the photoconductor 41 by the developing unit 43, is transferred to the intermediate transfer belt 51 by the transfer member 46.

The cleaner 44 removes residual substances that remain on the photoconductor 41 after the toner image has been transferred.

As described above, the image forming unit 20 includes four image forming engines 40, which respectively form yellow, magenta, cyan, and black toner images. Four toner tanks 47 are disposed above the image forming unit 20, and the four toner tanks 47 respectively contain color toners used by the four image forming engines 40. When a color toner in one of the developing units 43 of the image forming engines 40 decreases, the color toner is supplied to the developing unit 43 from one of the toner tanks 47 that contains the color toner.

The intermediate transfer belt 51 is an endless belt that is looped over the transfer member 46 and rollers 52 and that extends in the direction of arrow E. A transfer member 53 is disposed at a position near the intermediate transfer belt 51 and opposite the intermediate transfer belt 51 with the transport path of the sheet P therebetween. The cleaner 60 is disposed at a position further downstream of the transfer member 53 in the direction in which the intermediate transfer belt 51 moves. The cleaner 60 removes residual substances, such as toner, that remain on the intermediate transfer belt 51 after the toner images have been transferred.

The color toner images, which have been formed by the four image forming engines 40, are successively transferred to the intermediate transfer belt 51 in an overlapping manner.

The sheet P, which has been transported to the standby rollers 34, is fed by the standby rollers 34 so that the sheet P reaches a transfer position when the color toner images on the intermediate transfer belt 51 reach the transfer portion in which the transfer member 53 is disposed. At the transfer position, the transfer member 53 transfers the color toner images on the intermediate transfer belt 51 to the sheet P. The sheet P, on which the toner images have been transferred, is transported by a transfer belt 35 in the direction of arrow F. A fixing unit 23 heats and presses the sheet P to form a fixed toner image on the sheet P. Then, the sheet passes through the fixing unit 23, and the sheet is transported in the direction of arrow G and output to a sheet output tray 21.

The cleaner 60 cleans the intermediate transfer belt 51. That is, the cleaner 60 removes residual substances, such as toner, from the intermediate transfer belt 51. The residual substances are substances that remain on the intermediate transfer belt 51 after the transfer member 53 has transferred the toner images.

Figure 2:
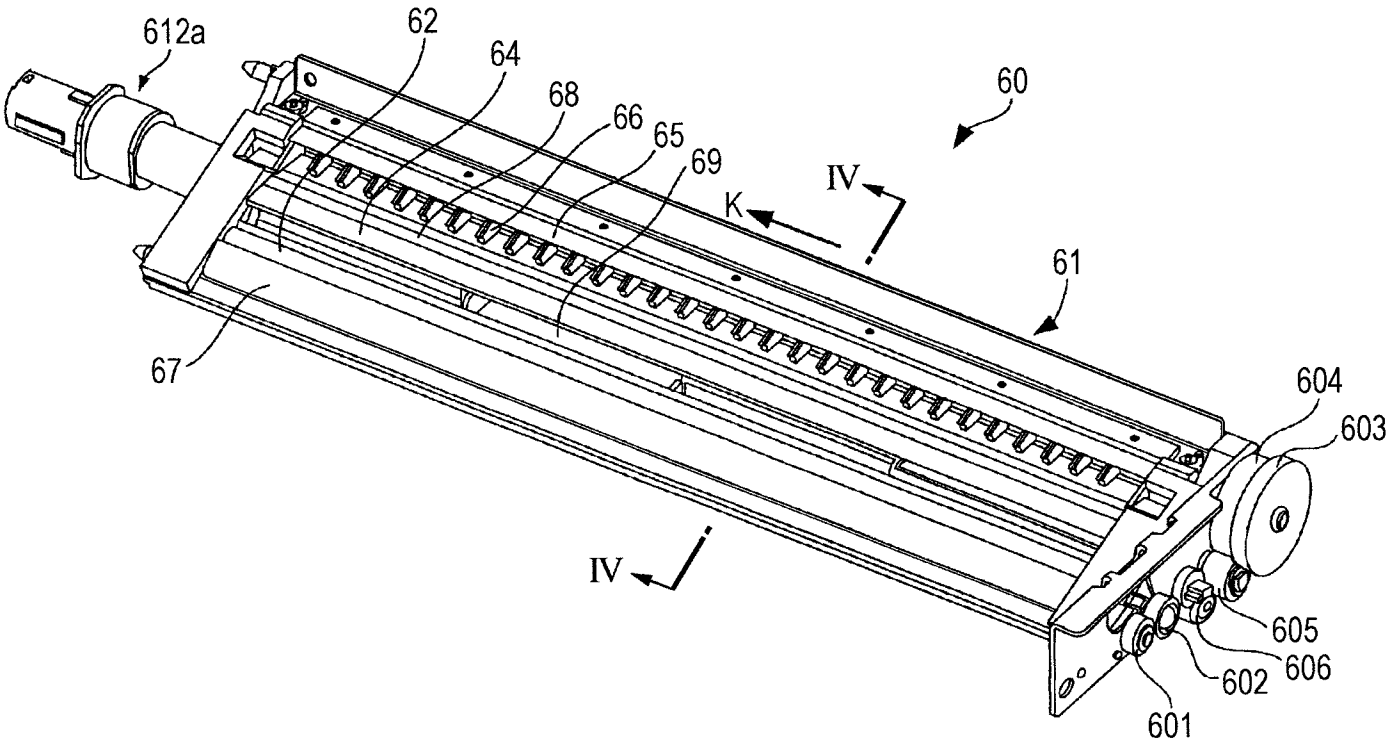
FIG. 2 is a perspective view of a cleaner for cleaning an intermediate transfer belt, illustrating a side of the cleaner that faces the intermediate transfer belt.
Figure 3:
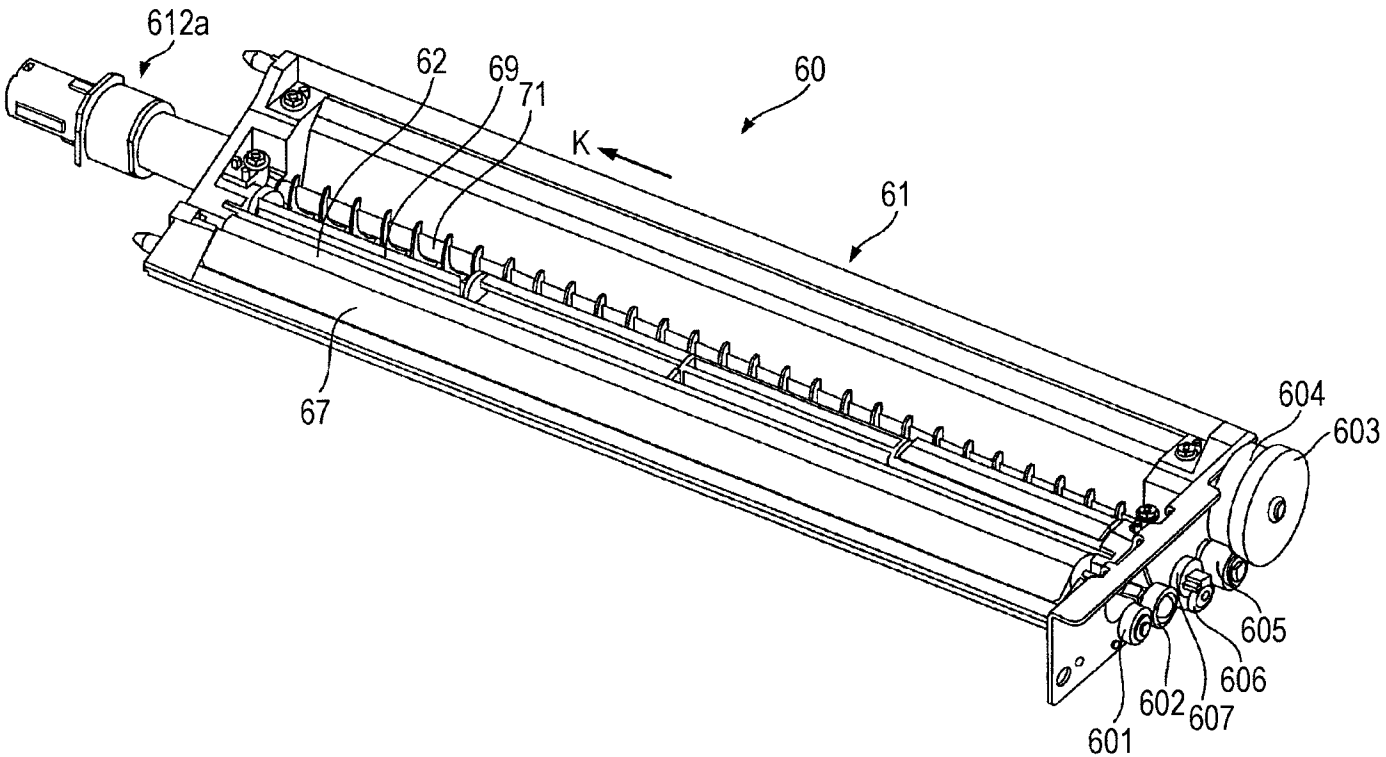
FIG. 3 is a perspective view of the cleaner of FIG. 2 from which a blade and a scraper are removed.
Figure 4:
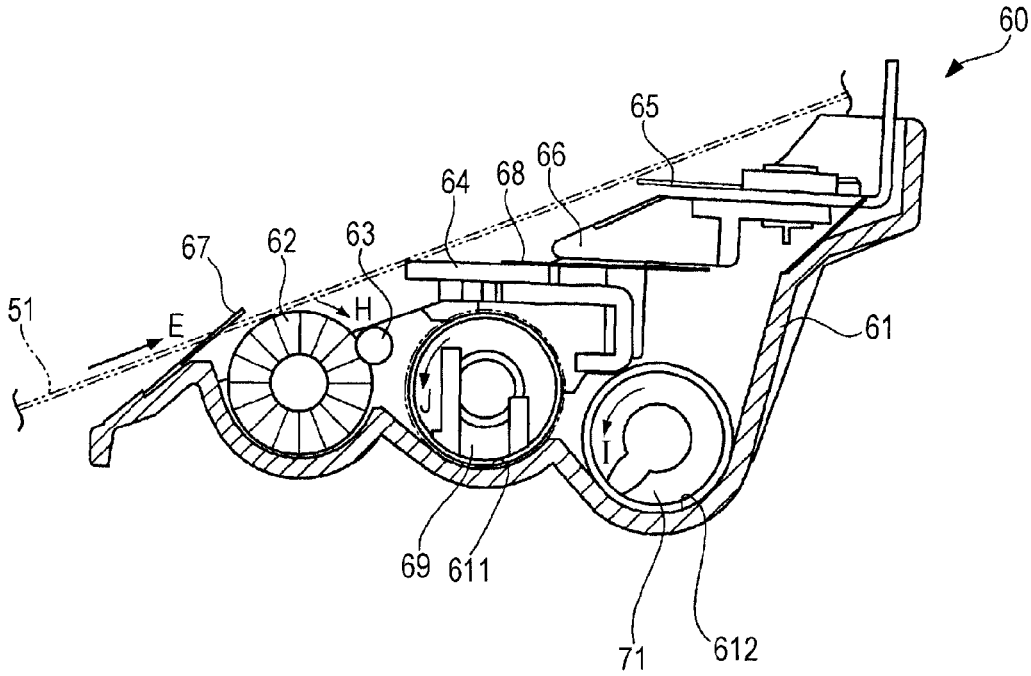
FIG. 4 is a sectional view of the cleaner of FIG. 2 taken along line IV-IV of FIG. 2.

FIG. 2 is a perspective view of the cleaner 60 for cleaning the intermediate transfer belt 51, illustrating a side of the cleaner 60 that faces the intermediate transfer belt 51. FIG. 3 is a perspective view of the cleaner 60 of FIG. 2 from which a blade and a scraper are removed. FIG. 4 is a sectional view of the cleaner of FIG. 2 taken along line IV-IV of FIG. 2.

The cleaner 60 includes a brush 62 disposed in a housing 61.

The brush 62 extends in the width direction of the intermediate transfer belt 51 (which is indicted by arrow K in FIGS. 2 and 3 and is perpendicular to the paper surface of FIG. 4) that intersects the direction in which the intermediate transfer belt 51 moves (indicated by arrow E). Both ends of the brush 62 are rotatably supported by the housing 61. The brush 62 is rotated in the direction of arrow H of FIG. 4 by a driving force that is generated by a motor (not shown) disposed in the image forming apparatus and that is transmitted through a gear 601 (see FIGS. 2 and 3) and a gear 602 that is coaxially fixed to the brush 62. The brush 62 rubs a surface of the intermediate transfer belt 51 that is moving and removes residual substances, such as toner, that adhere to the intermediate transfer belt 51 from the intermediate transfer belt 51. A flicker bar 63, which extends parallel to the brush 62 in the width direction, scrapes off the residual substances that adhere to the brush 62.

The cleaner 60 includes a blade 64. The blade 64 is made of a rubber and has a leading end that contacts the surface of the intermediate transfer belt 51. The blade 64 scrapes off the residual substances that have not been removed by the brush 62 and that remain on the intermediate transfer belt 51. The cleaner 60 further includes a scraper 65 made of a thin metal plate. The scraper 65 cleans the surface of the intermediate transfer belt 51 by removing toner particles and the like that have not been removed from the intermediate transfer belt 51 by the blade 64. A protection member 66 is disposed at a position that corresponds to the leading end of the scraper 65.

The cleaner 60 includes a sealing member 67 disposed at a position upstream of the brush 62 in the direction in which the intermediate transfer belt 51 moves (the direction of arrow E). The sealing member 67 prevents toner powder and the like that are scattered in the housing 61 due to rotation of the brush 62 or the like from leaking in the upstream direction.

The cleaner 60 further includes a shield sheet 68 that extends between the upper surface of the blade 64 and the lower surface of the protection member 66. The shield sheet 68 also prevents the toner powder or the like in the housing from scattering.

Although the scraper 65 is positioned above the shield sheet 68, this does not cause a problem because the amount of toner powder and the like that are removed by the scraper 65 is very small.

The cleaner 60 further includes a paddle 69 and an auger 71. As with the brush 62, the paddle 69 and the auger 71 extend in the width direction of the intermediate transfer belt 51, and both ends of each of the paddle 69 and the auger 71 are rotatably supported by the housing. The auger 71 is rotated in the direction of arrow I (see FIG. 4) by a driving force that is generated by a motor (not shown) disposed in the image forming apparatus and that is transmitted through a gear 603 (see FIGS. 2 and 3), a gear 604 that is coaxial with the gear 603, and a gear 605 that is coaxially fixed to the auger 71. The driving force transmitted to the gear 605 is further transmitted through a gear 606 to a gear 607 that is coaxially fixed to the paddle 69, whereby the paddle 69 is rotated in the direction of arrow J. The paddle 69 is disposed in a container chamber 611 (an example of a first container chamber) in the housing 61, which has an arc-shaped bottom surface and extends in the width direction. The auger 71 is disposed in a transport chamber 612 (an example of a second container chamber), which also has an arc-shaped bottom surface and extends in the width direction. Except for an end portion 612*a* of the transport chamber 612 (see FIGS. 2 and 3), only the bottom surfaces are independently formed in the container chamber 611 and the transport chamber 612, and upper spaces of the container chamber 611 and the transport chamber 612 are connected to each other through a wide opening. The gear 607, which is coaxially fixed to the paddle 69, is not a bevel gear but a spur gear. Therefore, the paddle 69 is movable within play in the axial direction. A sealing member 80 (see FIG. 6) is used to reduce the play of the paddle 69. The details will be described below. In the present exemplary embodiment, the paddle 69 is an example of a rotation member and a rotary shaft member.

Most of residual substances, such as toner powder, that have been scraped off the intermediate transfer belt 51 by the brush 62 and the blade 64 drop into the container chamber 611. The paddle 69 rotates in the direction of arrow J and moves the residual substances in the container chamber 611 to the transport chamber 612. The auger 71 rotates in the direction of arrow I, and transports the residual substance moved from the container chamber 611 in the width direction (indicated by arrow K in FIGS. 2 and 3). The end portion 612*a* (see FIGS. 2 and 3) of the transport chamber 612 has a protruding shape, and the auger 71 extends into the end portion 612*a* (see FIG. 5 described below). The auger 71 moves the residual substances in the transport chamber 612 to the end portion 612*a*. An opening (not shown) through which the residual toner drops is formed in the end portion 612*a*. The residual substances, which have been transported in the transport chamber 612 in the direction of arrow K, are dropped from the end portion 612*a* into a recovery container (not shown).

Figure 5:
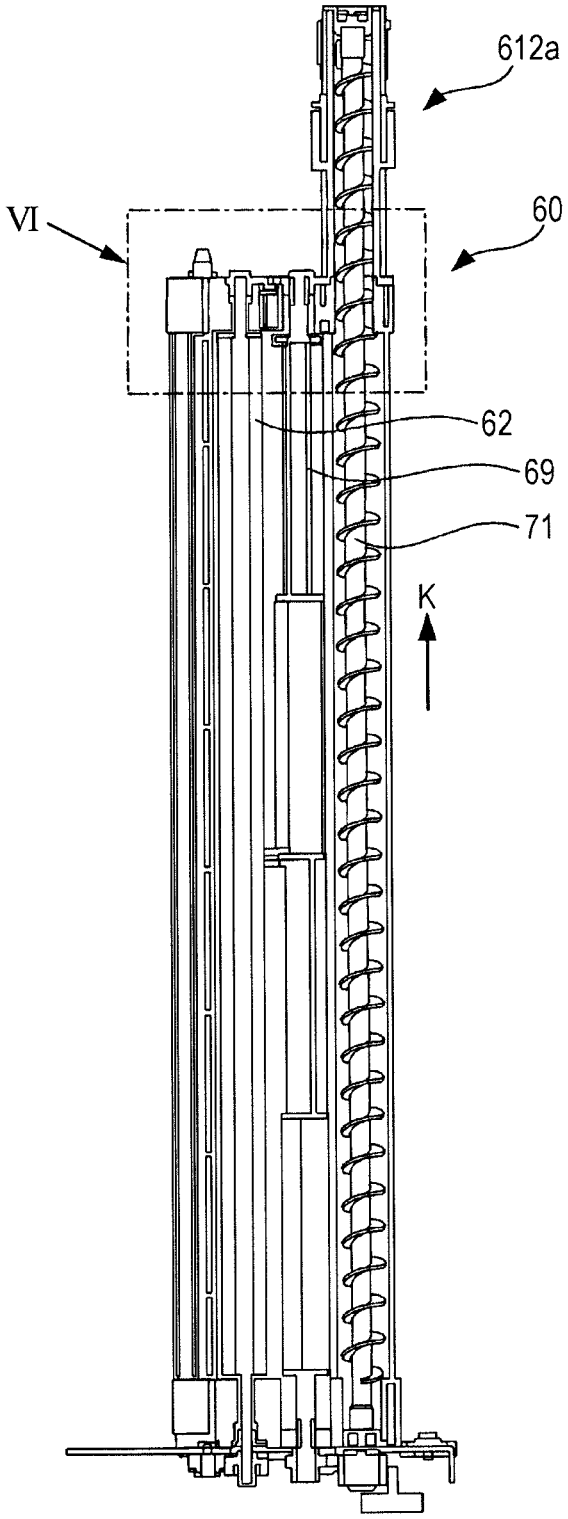
FIG. 5 is a cutaway view of the cleaner, illustrating a brush, a paddle, and a rotation shaft of an auger.
Figure 6:
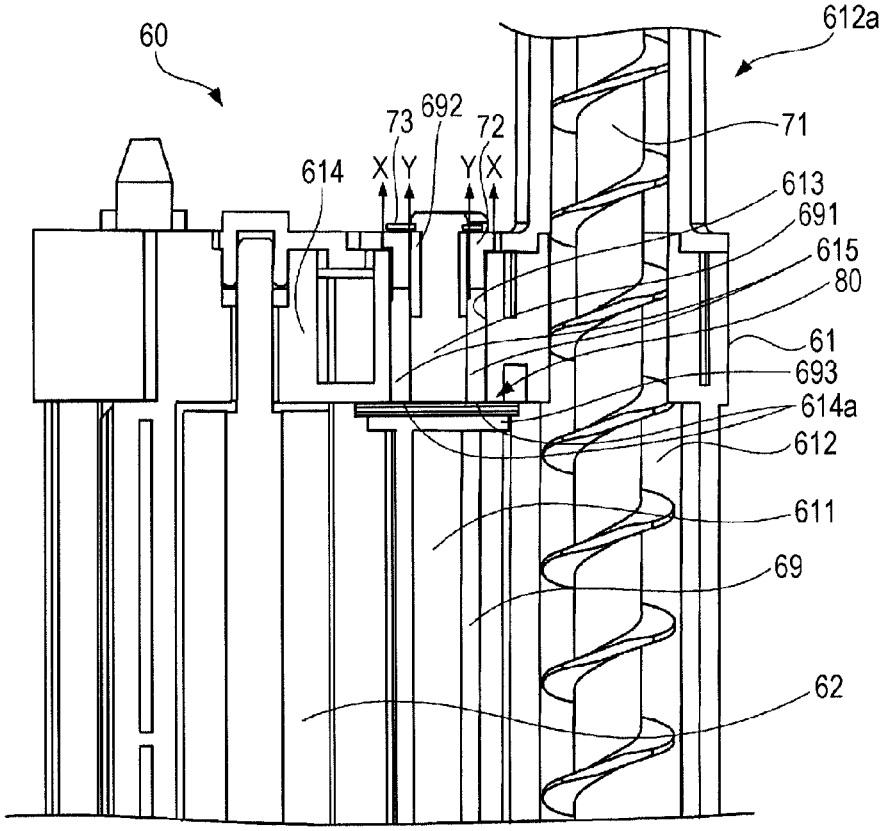
FIG. 6 is an enlarged view of a part of the cleaner, which is surrounded by an alternate long and short dash line in FIG. 5.
Figure 7:
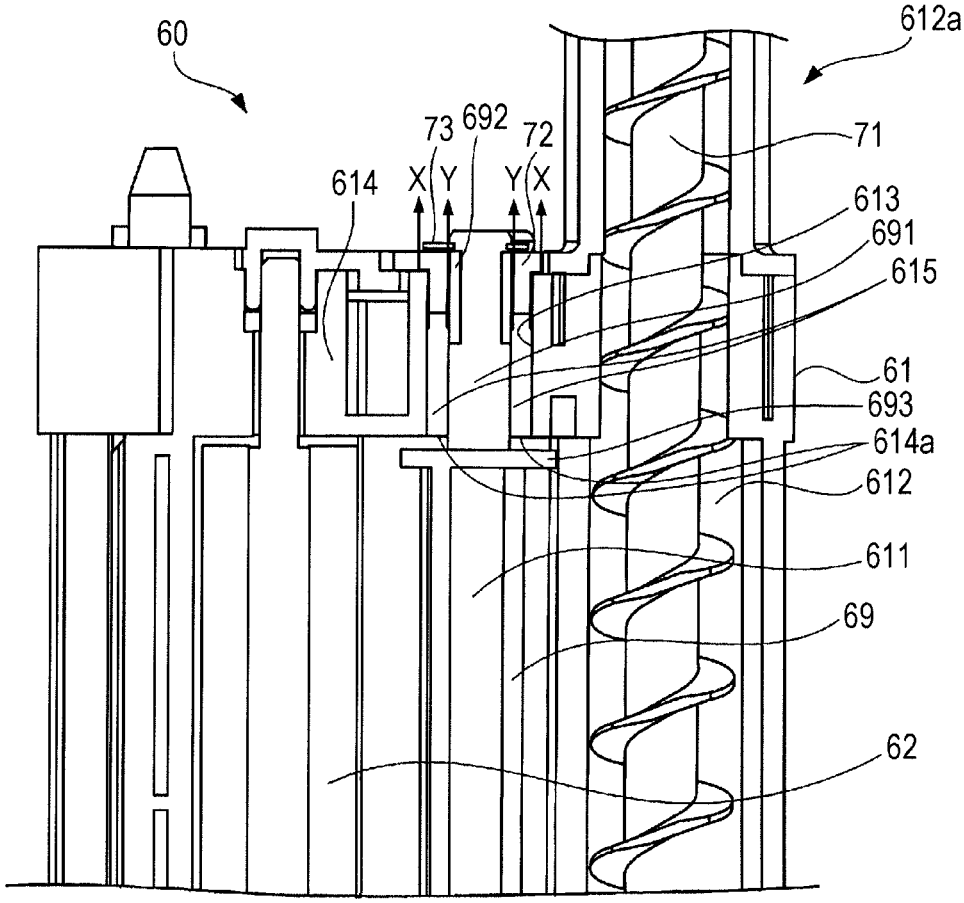
FIG. 7 is an enlarged view of a cleaner according to a comparative example, illustrating a part corresponding to that of FIG. 6.

FIG. 5 is a cutaway view of the cleaner, illustrating the brush 62, the paddle 69, and the rotation shaft of the auger 71. FIG. 6 is an enlarged view of a part of the cleaner 60 surrounded by an alternate long and short dash line of FIG. 5. FIG. 7 is an enlarged view of a cleaner according to a comparative example, illustrating a part corresponding to that of FIG. 6.

Here, the structure of an end portion of the paddle 69 and a mechanism for rotatably supporting the paddle 69 will be described.

The cleaner of FIG. 6 differs from that of FIG. 7 in that the cleaner of FIG. 7 does not include the sealing member 80, which is illustrated in FIG. 6. The comparative example illustrated in FIG. 7 will be describe first, and then the structure and the function of the sealing member 80 illustrated in FIG. 6 will be described.

The housing 61 of the cleaner 60 has a wall 614 (an example of a first wall portion) that defines an end of the container chamber 611 (see FIG. 4) in the axial direction in which the rotation axis extends. The wall 614 is disposed at an end of the housing 61 in the axial direction (indicated by arrow K in FIG. 5) in which the residual substances in the transport chamber 612 is transported by the auger 71. The wall 614 has a hole 613 (an example of a first hole) that extends through the housing 61 and into which an end portion 691 of the paddle 69 is inserted. A bearing 72 is fitted into the hole 613. A metal sleeve 692 is fitted to the end portion 691 of the paddle 69. The end portion 691 of the paddle 69 is inserted into the hole 613 so that the metal sleeve 692 contacts the bearing 72. As illustrated in FIG. 7, the end portion 691 of the paddle 69 is inserted into the hole 613 and retained by an E-shaped retaining ring 73. In the hole 613, a gap 615 having a width of about 1 mm is formed between the wall 614 and the end portion 691 of the paddle 69.

The paddle 69 has a wall portion 693 (an example of a second wall portion) that is located in the container chamber 611 when the end portion 691 of the paddle 69 is inserted into the hole 613 in the wall 614 (as illustrated in FIGS. 6 and 7). The wall portion 693 extends along a plane that intersects the rotation axis of the paddle 69. The wall portion 693 faces a portion 614*a* of the wall 614 around the hole 613 with a distance therebetween. The distance between the portion 614*a* of the wall 614 of the housing 61 around the hole 613 and the wall portion 693 of the paddle 69 is also about 1 mm.

As illustrated in FIG. 4, only the bottom portions of the transport chamber 612 and the container chamber 611 are independently formed, and the upper parts of the transport chamber 612 and the container chamber 611 are connected to each other through a wide opening. Therefore, when the auger 71 transports residual substances such as toner in the transport chamber 612 in the direction of arrow K (see FIG. 5), residual substances in the container chamber 611 are pushed in the same direction. The residual substances in the container chamber 611 may pass through a gap between the portion 614*a* around the hole 613 and the wall portion 693, and through a gap in the hole 613, and may leak along paths indicated by arrows X of FIG. 7. If the outer periphery of the bearing 72 is shielded by an O-ring or the like to prevent the leakage, the residual substances may leak along paths indicated by arrows Y of FIG. 7.

In the exemplary embodiment illustrated in FIG. 6, the sealing member 80, which will be described below, is disposed between the portion 614*a* of the wall 614 of the housing 61 around the hole 613 and the wall portion 693 of the paddle 69. The sealing member 80 prevents leakage of the residual substances along the paths indicated by arrows X and Y of FIG. 7.

Figure 8:
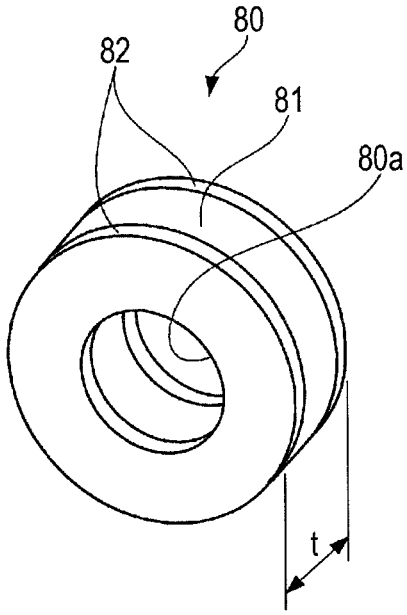
FIG. 8 is an enlarged perspective view of a sealing member.

FIG. 8 is an enlarged perspective view of the sealing member 80.

The sealing member 80 has a disc-like shape having a circular hole 80*a* (an example of a second hole) at the center thereof. The sealing member 80 has three layers including a foam member 81 and a pair of sheet members 82 that sandwich the foam member 81. The sheet members 82 have a friction coefficient that is lower than that of the foam member 81. To be specific, the foam member 81 may be made of a polyurethane foam, and the sheet members 82 may be made of a PET film.

As illustrated in FIG. 6, the sealing member 80 is disposed between the portion 614*a* around the hole 613 of the wall 614 of the housing 61 and the wall portion 693 of the paddle 69. One of the sheet members 82 is in contact with but is not bonded the portion 614*a* around the hole 613. If heat is generated by friction in this region, the residual substances in the region may melt and may impede the rotation of the paddle 69. The sealing member 80 according to the present exemplary embodiment has the three-layer structure having the sheet members 82 on both sides thereof, and the sheet members 82 have a friction coefficient lower than that of the foam member 81. Therefore, the amount of heat generated by the friction is small when the paddle 69 rotates.

If the foam member 81 directly contacts the housing 61 and the paddle 69, the foam member 81 may wear at the contact portion due to friction between the foam member 81 and the housing 61 and the paddle 69, or powder generated by the friction may produce an adverse effect in the housing 61. However, because the sheet members 82 are provided in the present exemplary embodiment, the foam member 81 is prevented from wearing.

A circular hole 80*a* at the center of the sealing member 80 is a hole through which a part of the paddle 69 immediately outside of the wall portion 693 extends. The diameter of the circular hole 80*a* is larger than the diameter of the shaft of the paddle 69 that extends through the circular hole 80*a*. Because the circular hole 80*a* has a diameter larger than the diameter of the shaft of the paddle 69 that extends through the circular hole 80*a*, when the paddle 69 rotates, the paddle 69 is prevented from contacting the foam member 81 on the inner wall of the circular hole 80*a*, whereby heat generated by friction when the paddle 69 rotates is reduced also in this respect.

The sealing member 80 has dimensions such that, when the center of the circular hole 80*a* is made to coincide with the rotation center of the shaft of the paddle 69 that extends through the circular hole 80*a*, the sealing member 80 does not contact a wall surface that defines the container chamber 611 of the housing 61 in a direction that intersects the direction of the rotation axis. The dimensions of the sealing member 80 will be described with reference to FIG. 9. Also because the sealing member 80 has dimensions that prevent contact, friction and heat due to the rotation of the paddle 69 are reduced.

The outer dimensions of the sealing member 80 and the diameter of the circular hole 80*a* are adjusted such that the upper edge of the circular hole 80*a* may not contact the paddle 69 even if the sealing member 80 is lowered to a position at which the sealing member 80 contacts the bottom surface of the container chamber 611. The details will be described with reference to FIG. 9. This also contributes to reduction in the friction and heat generated due to the rotation of the paddle 69.

Before the sealing member 80 is interposed between the portion 614*a* of the wall 614 around the hole 613 and the wall portion 693, the sealing member 80 has a thickness t in the axial direction (see FIG. 8) that is larger than the distance between the portion 614*a* of the wall 614 around the hole 613 and the wall portion 693. To be specific, in the present exemplary embodiment, the thickness t of the entirety of the three-layer structure is 4.0 mm. Therefore, the foam member 81 is in a compressed state when the sealing member 80 is interposed between the portion 614*a* of the wall 614 around the hole 613 and the wall portion 693. As described above, the paddle 69 is not fixed in the axial direction, and is movable within play. By disposing the sealing member 80 in the compressed state, the play of the paddle 69 is reduced due to the resilience of the foam member 81. The sealing member 80 prevents leakage of the residual substances through a space between the metal sleeve 692 and the bearing 72 not only by closing the gap between the portion 614*a* of the wall 614 around the hole 613 and the wall portion 693 but also by reducing the play of the paddle 69.

Figure 9:
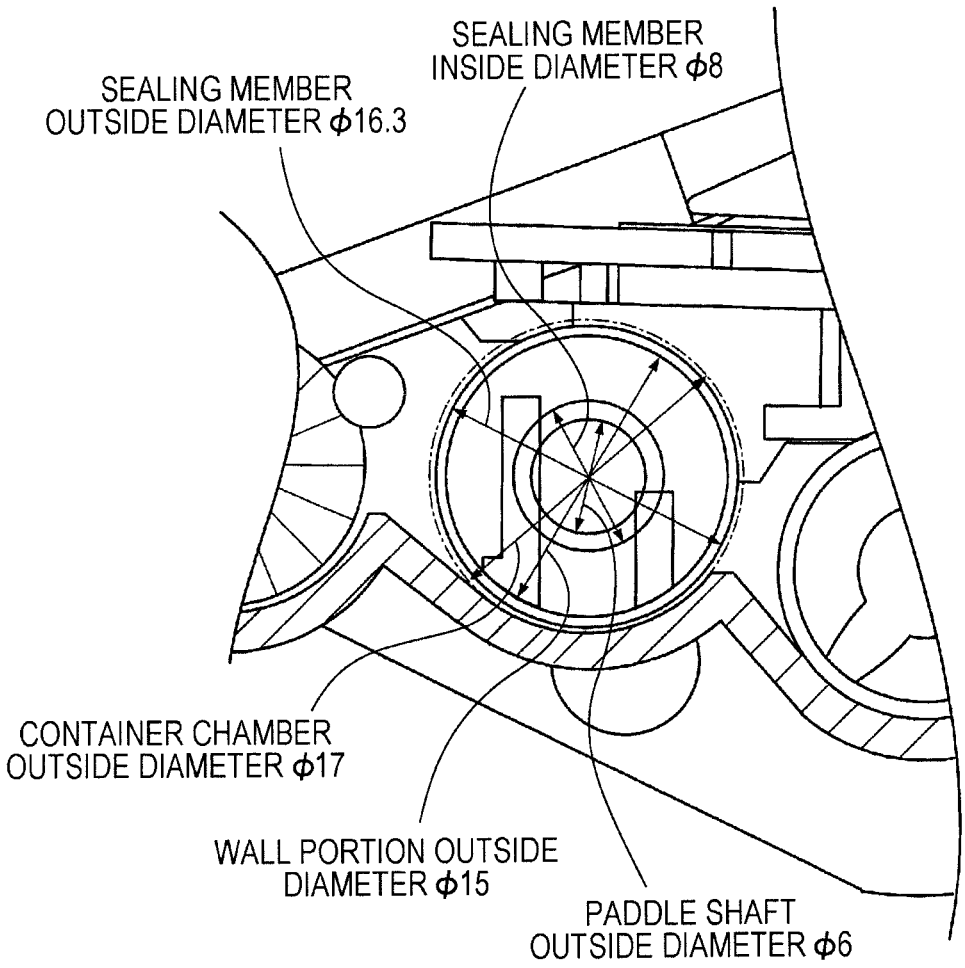
FIG. 9 is a schematic view illustrating the dimensions of the sealing member and components surrounding the sealing member.

FIG. 9 is a schematic view illustrating the dimensions of the sealing member 80 and components surrounding the sealing member 80. The dimensions illustrated in FIG. 9 are examples.

The inside diameter of the sealing member (the diameter of the circular hole 80*a* (see FIG. 8)) is ϕ8 (8 mm), the outside diameter of the sealing member is ϕ16.3. The outside diameter of the shaft of the paddle 69 extending through the circular hole 80*a* is ϕ6. Therefore, when the center of the circular hole 80*a* coincides with the rotation center of the shaft, a gap having a width of 1 mm is formed along the inner periphery of the circular hole 80*a*.

The outside diameter of the container chamber 611 is ϕ17, if it is assumed that the arc of the bottom surface is extended. Because the sealing member has an outside diameter of ϕ16.3, when the center of the sealing member coincides with the center of the container chamber, the sealing member does not contact the wall that defines the container chamber. The container chamber has an outside diameter of ϕ17, the sealing member has an outside diameter of ϕ16.3, the shaft of the paddle has an outside diameter of ϕ6, and the circular hole of the sealing member has a diameter of ϕ8. Therefore, even if the sealing member lowers under its own weight to a position at which the sealing member contacts the bottom surface of the container chamber, the shaft of the paddle does not contact the upper edge of the circular hole. As described above, with such a configuration, the friction generated due to the rotation of the paddle is further reduced.

The cleaner described above is used to clean the intermediate transfer belt of the image forming apparatus. However, this is not limited thereto, and the cleaner may be used to clean, for example, a photoconductor. The present invention is not limited to a cleaning device, and is broadly applicable to a powder container including a housing, a container chamber and a rotation member that are disposed in the housing, the container chamber containing powder.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A powder container comprising:

a housing including a container chamber for containing powder;

a rotation member disposed in the housing, the rotation member extending in an axial direction in which a rotation axis extends and rotating around the rotation axis; and a sealing member, wherein the housing includes a first wall portion having a first hole extending through the housing, an end portion of the rotation member in the axial direction being inserted into the first hole, the first wall portion defining an end of the container chamber in the axial direction, wherein the rotation member includes a second wall portion extending along a plane that intersects the rotation axis in the container chamber in a state in which the end portion of the rotation member is inserted into the first hole, the second wall portion facing a part of the first wall portion around the first hole with a distance therebetween, and wherein the sealing member has a second hole through which the rotation member extends, the sealing member is interposed between the part of the first wall portion around the first hole and the second wall portion, and the sealing member includes a foam member and a pair of sheet members sandwiching the foam member therebetween, the foam member being contractible due to pressure, the pair of sheet members respectively contacting the part of the first wall portion around the first hole and the second wall portion, the pair of sheet members having a friction coefficient lower than a friction coefficient of the foam member, the pair of sheet members not being bonded to the part of the first wall portion around the first hole and the second wall portion, and wherein outer dimensions of the sealing member and a dimension of the second hole are adjusted such that an upper edge of the second hole does not contact the rotation member in a state in which the sealing member is lowered to a position at which the rotation member contacts a bottom surface of the container chamber.

2. The powder container according to claim 1, wherein the second hole formed in the sealing member is a circular hole having a diameter larger than a diameter of a part of the rotation member that extends through the second hole.

3. The powder container according to claim 1, wherein the sealing member has dimensions such that the sealing member does not contact a wall of the housing that defines the container chamber with respect to a direction that intersects the axial direction when a center of the second hole coincides with a center of a the rotation member that extends through the second hole.

4. The powder container according to claim 1, wherein, before the sealing member is interposed between the part of the first wall portion around the first hole and the second wall portion, the sealing member has a thickness in the axial direction that is larger than a distance between the part of the first wall portion around the first hole and the second wall portion.

5. A cleaning device comprising:

a removing member extending in a width direction that intersects a movement direction of an image carrier that carries a toner image and transfers the toner image to a transferred member while moving, the removing member removing a residual substance from the image carrier by contacting a part of the image carrier from which the toner image has been transferred;

a housing including a first container chamber and a second container chamber, the first container chamber extending in the width direction and containing the residual substance removed from the image carrier by the removing member, the second container chamber having an opening connected to the first container chamber, the second container chamber disposed adjacent to the first container chamber and extending in the width direction, the second container chamber containing the residual substance that is received from the first container chamber;

a delivery member including a rotary shaft member extending in the width direction, the delivery member being disposed in the first container chamber and delivering the residual substance in the first container chamber to the second container chamber as the rotary shaft member rotates;

a transport member disposed in the second container chamber and rotating around a rotation axis extending in the width direction, the transport member transporting the residual substance in the second container chamber downstream in the width direction; and a sealing member, wherein the housing includes a first wall portion having a first hole extending through the housing, an end portion of the rotary shaft member on a downstream side in the width direction being inserted into the first hole, the first wall portion defining the downstream side of the first container chamber in the width direction, wherein the rotary shaft member includes a second wall portion extending along a plane that intersects the width direction in the first container chamber in a state in which the end portion of the rotary shaft member on the downstream side in the width direction is inserted into the first hole, the second wall portion facing a part of the first wall portion around the first hole with a distance therebetween, wherein the sealing member has a second hole through which the rotary shaft member extends, the sealing member is interposed between the part of the first wall portion around the first hole and the second wall portion, and the sealing member includes a foam member and a pair of sheet members sandwiching the foam member therebetween, the foam member being contractible due to pressure, the pair of sheet members respectively contacting the part of the first wall portion around the first hole and the second wall portion, the pair of sheet members having a friction coefficient lower than a friction coefficient of the foam member, the pair of sheet members not being bonded to the part of the first wall portion around the first hole and the second wall portion, and wherein outer dimensions of the sealing member and a dimension of the second hole are adjusted such that an upper edge of the second hole does not contact the rotation member in a state in which the sealing member is lowered to a position at which the rotation member contacts a bottom surface of the container chamber.

6. An image forming apparatus comprising:

an image carrier that carries a toner image and transfers the toner image to a transferred member while moving;

a toner image forming unit that forms the toner image and causes the image carrier to carry the toner image;

a transfer fixing unit that transfers the toner image formed on the image carrier to a transferred member and fixes the toner image on the transferred member to form a fixed toner image on the transferred member; and a cleaning device that cleans a part of the image carrier from which the toner image has been transferred, wherein the cleaning device includes a removing member extending in a width direction that intersects a movement direction of the image carrier, the removing member removing a residual substance from the image carrier by contacting a part of the image carrier from which the toner image has been transferred, a housing including a first container chamber and a second container chamber, the first container chamber extending in the width direction and containing the residual substance removed from the image carrier by the removing member, the second container chamber having an opening connected to the first container chamber, the second container chamber disposed adjacent to the first container chamber and extending in the width direction, the second container chamber containing the residual substance that is received from the first container chamber, a delivery member including a rotary shaft member extending in the width direction, the delivery member being disposed in the first container chamber and delivering the residual substance in the first container chamber to the second container chamber as the rotary shaft member rotates, a transport member disposed in the second container chamber and rotating around a rotation axis extending in the width direction, the transport member transporting the residual substance in the second container chamber downstream in the width direction, and a sealing member, wherein the housing includes a first wall portion having a first hole extending through the housing, an end portion of the rotary shaft member on a downstream side in the width direction being inserted into the first hole, the first wall portion defining the downstream side of the first container chamber in the width direction, wherein the rotary shaft member includes a second wall portion extending along a plane that intersects the width direction in the first container chamber in a state in which the end portion of the rotary shaft member on the downstream side in the width direction is inserted into the first hole, the second wall portion facing a part of the first wall portion around the first hole with a distance therebetween, wherein the sealing member has a second hole through which the rotary shaft member extends, the sealing member is interposed between the part of the first wall portion around the first hole and the second wall portion, and the sealing member includes a foam member and a pair of sheet members sandwiching the foam member therebetween, the foam member being contractible due to pressure, the pair of sheet members respectively contacting the part of the first wall portion around the first hole and the second wall portion, the pair of sheet members having a friction coefficient lower than a friction coefficient of the foam member, the pair of sheet members not being bonded to the part of the first wall portion around the first hole and the second wall portion, and wherein outer dimensions of the sealing member and a dimension of the second hole are adjusted such that an upper edge of the second hole does not contact the rotation member in a state in which the sealing member is lowered to a position at which the rotation member contacts a bottom surface of the container chamber.

* * * * *